US007635095B2

(12) United States Patent
Jaeger

(10) Patent No.: US 7,635,095 B2
(45) Date of Patent: Dec. 22, 2009

(54) ROTOR NOZZLE

(75) Inventor: Anton Jaeger, Hofackergasse 3, D-89250 Senden (DE)

(73) Assignee: Anton Jaeger, Senden (DE)

( * ) Notice: Subject to any disclaimer, the term of this patent is extended or adjusted under 35 U.S.C. 154(b) by 79 days.

(21) Appl. No.: 11/939,123

(22) Filed: Nov. 13, 2007

(65) Prior Publication Data

US 2008/0164343 A1 Jul. 10, 2008

(30) Foreign Application Priority Data

Nov. 14, 2006 (DE) ..... 10 2006 053 625

(51) Int. Cl.
*B05B 3/04* (2006.01)

(52) U.S. Cl. ..... 239/237; 239/240; 239/263; 239/381; 239/443; 239/562

(58) Field of Classification Search ..... 239/225.1, 239/237, 240, 246, 263, 264, 380, 381, 436, 239/443, 444, 548, 562
See application file for complete search history.

(56) References Cited

U.S. PATENT DOCUMENTS

| | | | | |
|---|---|---|---|---|
| 5,328,097 | A | 7/1994 | Wesch et al. | |
| 5,332,155 | A * | 7/1994 | Jager | 239/240 |
| 5,395,053 | A * | 3/1995 | Frech | 239/263 |
| 6,029,906 | A * | 2/2000 | Binder et al. | 239/237 |
| 6,736,333 | B2 * | 5/2004 | Binder et al. | 239/225.1 |
| 2004/0046072 | A1 | 3/2004 | Kois | |

FOREIGN PATENT DOCUMENTS

| | | |
|---|---|---|
| DE | 4013446 | 5/1991 |

(Continued)

OTHER PUBLICATIONS

German Search Report dated Sep. 24, 2007. DE 10 2006 053 625.8.

*Primary Examiner*—Steven J Ganey
(74) *Attorney, Agent, or Firm*—Gifford, Krass, Sprinkle, Anderson & Citkowski, P.C.

(57) ABSTRACT

The invention relates to a rotor nozzle, in particular for high pressure devices, having a nozzle housing which has a swirl chamber between a rear inflow opening for a fluid, in particular water, and a front outlet opening, with a front end of a rotor, which is inclined during operation toward a longitudinal axis, being supported at a bearing, in particular a cup-shaped bearing, in said swirl chamber and being able to be driven by fluid flowing into the swirl chamber to make a rotary movement around the longitudinal axis such that the fluid exits the nozzle housing via the outlet opening in the form of a conical jet, and having a gravity circuit which includes at least one movable switching element and which switches between at least two different operating modes by movement of the rotor nozzle in the space, wherein the gravity circuit is arranged in the front region of the rotor nozzle downstream of the swirl chamber, wherein the switching element releases the outlet opening and closes a functional opening of the nozzle housing provided in addition to the outlet opening, in one operating mode, and wherein the additional functional opening is released in at least one further operating mode in which the outlet opening is sealingly closed by the switching element.

14 Claims, 5 Drawing Sheets

FOREIGN PATENT DOCUMENTS

Figure 1:
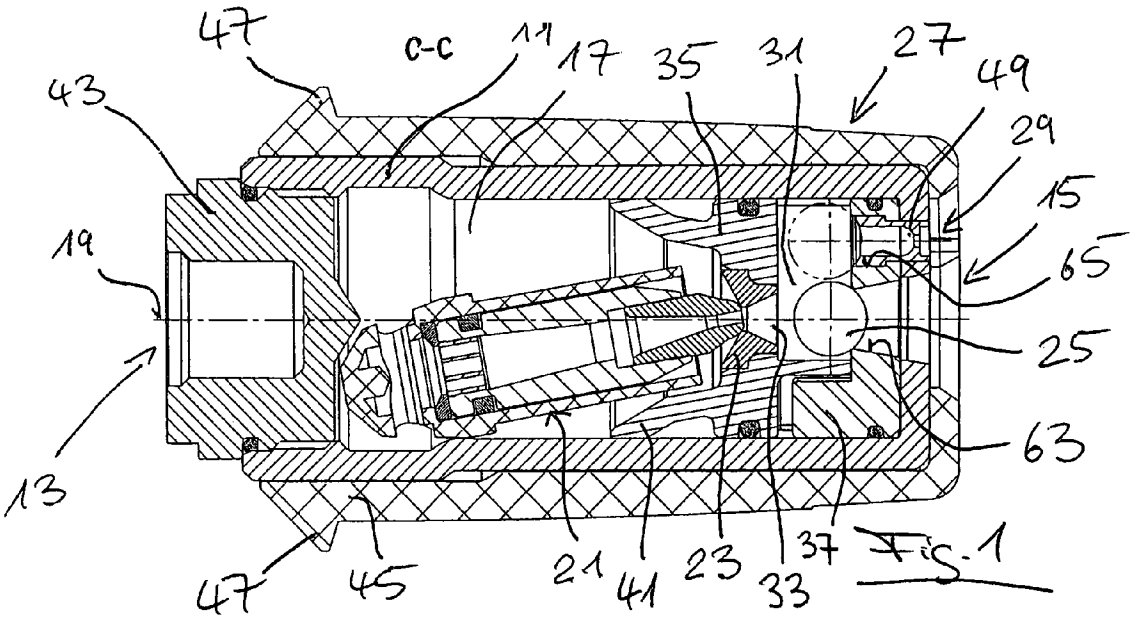
Figure 2:
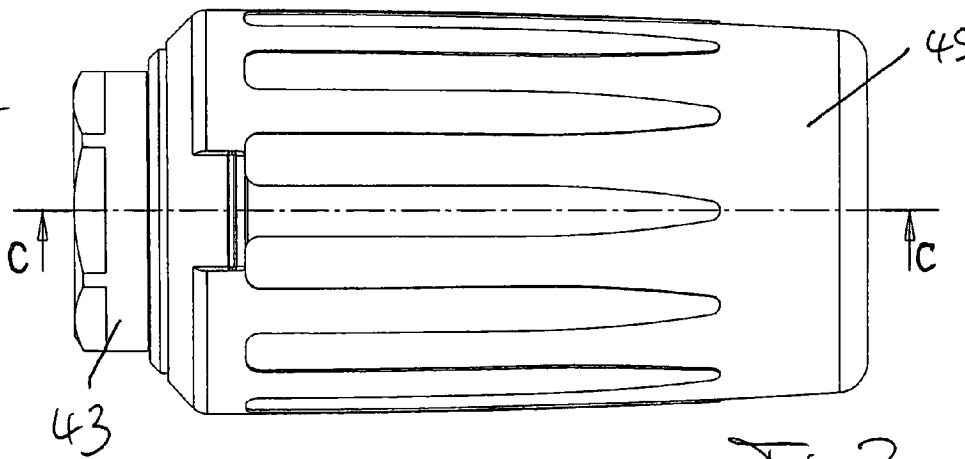

| | | |
|---|---|---|
| DE | 4319743 | 12/1994 |
| DE | 19709120 | 9/1998 |
| DE | 198 51 595 | 5/2000 |
| DE | 199 00 595 | 7/2000 |
| DE | 201 03 259 U1 | 7/2001 |
| DE | 200 22 545 | 1/2002 |
| DE | 10036970 | 2/2002 |
| DE | 101 20 296 | 10/2002 |
| DE | 10120296 | 10/2002 |
| DE | 101 54 836 | 5/2003 |
| DE | 102004022588 | 12/2005 |
| DE | 10 2006 025 931 | 12/2007 |
| EP | 0 466 415 | 1/1992 |
| EP | 0 974 399 A1 | 1/2000 |

* cited by examiner 37
15
30
55
29
51

53
41
57
59
35
E-E
37
31
15
25
30
26
33
35
41
21
17
11
19

ROTOR NOZZLE

CROSS REFERENCE TO RELATED APPLICATION

This application claims priority of German Patent Application No. DE 10 2006 053 625.8 filed Nov. 14, 2006.

The invention relates to a rotor nozzle, in particular for high pressure cleaning devices, having the features of the preamble of claim 1.

Rotor nozzles enabling a plurality of operating modes and provided for this purpose with switching devices which enable the user to switch between the different modes are generally known. Reference is made in this respect, for example, to DE 43 19 743, DE 101 20 296, DE 200 22 545, DE 40 13 446 and DE 197 09 120.

In particular the complicated structure and the time-consuming and/or expensive assembly and disassembly associated therewith are of disadvantage with the known multifunctional nozzles.

It is the object of the invention to provide a rotor nozzle of the initially named kind which enables a reliable switching between different operating modes with a structure which is as simple as possible and thus with a more cost-effective manner of manufacture and which can simultaneously be handled as simply as possible on assembly and disassembly.

This object is satisfied by the features of claim 1.

In accordance with the invention, the gravity circuit in the front region of the rotor nozzle is arranged downstream of the swirl chamber, with the switching element releasing the outlet opening and sealingly closing a functional opening of the nozzle housing provided in addition to the outlet opening in one operating mode and with the additional functional opening being released in at least one further operating mode in which the outlet opening is sealingly closed by the switching element.

A relatively simple structure of the rotor nozzle can be realized using a normal nozzle housing, which is in particular substantially cylindrical, in that, in accordance with the invention, the gravity circuit is disposed after the swirl chamber—considered in the direction of flow. The invention furthermore permits a simple handling in assembly and disassembly since a sequential arrangement of the gravity circuit and the swirl chamber can be realized in a common housing, which permits inserting the corresponding components into the housing or removing them from the housing in a simple sequential manner. It is furthermore of particular advantage that no measures are necessary to direct the fluid entering into the rotor nozzle either into the swirl chamber or past the swirl chamber depending on the operating mode set. Complex and/or expensive bypass solutions can therefore be dispensed with by the invention.

The arrangement in accordance with the invention of a gravity circuit in the front region of the rotor nozzle, that is a positioning of the gravity circuit disposed after the swirl chamber—seen in the direction of flow—signifies a departure from the previously realized designs. It has previously always been attempted to fix the flow path for the fluid before entry into the swirl chamber by switching measures either to select a rotary operation with a rotor rotating in the swirl chamber or to bypass the swirl chamber.

Provision is in particular made in the invention that the fluid is supplied to the additional functional opening only via the rotor. In this respect, contrary to the prior art, a pure sequential arrangement—seen in a technical flow manner—of first the swirl chamber and subsequently the additional functional opening is deliberately selected. Such a series connection of the corresponding flow resistances has not previously been realized in the prior art.

Further preferred embodiments of the invention are set forth in the dependent claims, in the description and in the drawing.

The switching element is preferably arranged in a size-variable space which can adopt an operating configuration and a switchover configuration which differ from on another by the effective size of the space, with the switching element being held or captured by boundaries determining the size of the space in accordance with the respectively set operating mode in the operating configuration and thus being prevented from a gravity-induced switchover, and with the boundaries of the space allowing a free switchover movement to the switching element in the switchover configuration.

In a preferred embodiment of the invention, the gravity circuit includes a switching and pressure chamber which includes the switching element and into which an exit opening of the swirl chamber opens upstream and the outlet opening and the additional functional opening of the nozzle housing open downstream. Such a switching and pressure chamber can be bounded in a simple manner by anyway required components as well as by the inner wall of the nozzle housing. The switching and pressure chamber makes a fluid space available from which the fluid, which enters into the switching and pressure chamber from the swirl chamber, i.e. via the rotor, leaves the rotor nozzle via the additional functional opening with a closed outlet opening. The switching and pressure chamber is consequently used both as a "cage" for the moving switching element and simultaneously as a pressure space for the fluid, whereby it is ensured that the fluid can be expelled from the additional functional opening at sufficiently high pressure. With a released outlet opening, the conical jet exiting the rotating rotor with a released outlet opening passes through the switching and pressure chamber at least substantially undisturbed.

In a particularly preferred embodiment, the switching and pressure chamber is bounded upstream by a piston member which is axially movable in the nozzle housing and which is acted on in the downstream direction with a pressurized swirl chamber.

The axial movability of this piston member has the consequence that during operation, that is with a pressurized swirl chamber, a reduction in size of the switching and pressure chamber is adopted—seen in the axial direction—with the extent of the reduction in size being able to be controlled by suitable means. This reduction in size can be utilized to secure the respectively set mode, in particular to prevent the moving switching element from leaving its position corresponding to the selected operating mode.

Furthermore, at least one restoring element, in particular a spring, can be arranged between the piston member and a boundary of the switching and pressure chamber disposed downstream, the restoring force of said spring element countering a reduction in size of the switching and pressure chamber which is caused by the action of the piston member with a pressurized swirl chamber. Such a restoring element can ensure that, with an unpressurized swirl chamber, that is e.g. in operating breaks, the switching and pressure chamber has a specific minimum size which is necessary to permit a movement of the switching element for the purpose of switching over into a different mode.

Provision is preferably made that a switching path is provided for the switching element between the piston member and the boundary disposed downstream, with the passage width of said switching path being dependent on the position of the piston member in the nozzle housing, said passage width being smaller with a pressurized swirl chamber and a switching and pressure chamber correspondingly reduced in size by the action of the piston member than the dimension of the switching element operative with respect to the passage width on the switchover.

As soon as the piston member has achieved its axial operating position due to the fluid pressure prevailing in the swirl chamber, there is consequently thereby no longer any possibility for the moving switching element to leave its previously adopted position.

The switching element is preferably provided in the form of a ball. A spherical switching element is, however, not compulsory. Generally, other geometrical designs for the switching element are also possible. The switching element can, for example, be made in roll shape.

The piston member can be provided with a security against tilting which is provided in the form of a support extension extending upstream and cooperating with the inner wall of the nozzle housing. Such a security against tilting makes it possible to arrange a restoring device, in particular one or more restoring springs, in generally any desired order since an arrangement of the restoring elements which may not be tilt-neutral can easily be compensated by the security against tilting. A correct alignment of the piston members, and thus of the jet geometry of the fluid exiting via the rotor is hereby ensured relative to the gravity circuit and to the outlet opening of the nozzle housing.

In a possible embodiment, two switching elements and two additional functional openings are provided. In this manner, three different operating modes can be realized in that the functional openings are made differently, for example as a spot jet nozzle, on the one hand, and as a flat jet nozzle, on the other hand.

As already initially indicated, the invention makes it possible in accordance with a preferred embodiment to arrange the swirl chamber and the gravity circuit sequentially seen in the direction of the longitudinal axis and within a common pressure housing forming the nozzle housing.

A boundary of the switching and pressure chamber disposed downstream can be made at a separate end piece. Alternatively, the boundary can generally also be formed by the nozzle housing itself.

Provision can furthermore preferably be made for the separate insert piece and a swirl chamber boundary disposed downstream, in particular a piston member, to able to be plugged into the nozzle housing and removed from the nozzle housing sequentially.

The insert piece and/or the swirl chamber boundary can be provided with means for the fixing of a switching path for the switching element, for the receiving of a restoring element and/or for the securing of a mutual relative rotary position with respect to the longitudinal axis.

The invention will be described in the following by way of example with reference to the drawing. There are shown:

FIGS. 1 to 4 different views of a first embodiment of a rotor nozzle in accordance with the invention; and FIGS. 5 to 10 different views of a second embodiment of a rotor nozzle in accordance with the invention.

With the rotor nozzle in accordance with FIGS. 1 to 4, the front end of a rotor 21 formed by a nozzle element is supported at a cup-shaped bearing 23 in a known manner in a swirl chamber 17 which is bounded by a pressure housing 11, a connection piece 43 also called a box and a piston member 35 described in more detail in the following, said bearing being provided as a separate element and being arranged at the piston member 35.

With the exception of the piston member 35, such an arrangement, including the general functional principle of a rotary nozzle is generally known so that this will not be looked at in more detail. It is only mentioned for better understanding that the fluid, which is in particular water, entering into the swirl chamber 17 via the box 43 with a radial and/or tangential component generates a swirl flow in the swirl chamber 17 which is also called a rotary field and which drives the rotor 21 to make a rotary movement around a longitudinal axis 19 of the rotor nozzle. Whereas the front end of the rotor 21 is supported at the cup bearing 23, a support takes place during operation in the region of the rear end by the inner wall of the nozzle housing 11. Due to this inclined arrangement of the rotor 21, the fluid entering into the rotor 21 in the rear region via the swirl chamber 17 is expelled via the nozzle element, an exit opening 33 of the swirl chamber 17 formed in the cup bearing 23, and thus in the piston member 35, and an outlet opening 15 of the nozzle housing 11 in the form of a conical jet.

A switching and pressure chamber 31 is located inside the nozzle housing 11 downstream of the piston member 35 and thus of the swirl chamber 17, that is behind the swirl chamber 17 seen in the direction of flow. This chamber 31 is bounded by the piston member 35 upstream and by a separate insert piece 37 downstream. The piston member 35 and the insert piece 37 can be made as injection molded plastic parts which can be manufactured relatively cost-effectively, which makes it possible to form special functional means, which will be looked at in more detail in the following, on the piston member 35 and on the insert piece 37 directly during the manufacture. The nozzle or pressure housing 11 is manufactured from metal, for example from brass.

The switching and pressure chamber 31 is a component of a gravity circuit 27 of the rotor nozzle which has the purpose of switching between the rotary operation or conical jet operation and a further functional mode. For thus purpose, a freely movable switching element in the form of a ball 25 is located in the switching and pressure chamber 31. The ball 25 serves as a sealing element which closes either the central outlet opening 15 for the conical jet or an additional eccentrically arranged functional opening 29 selectively in dependence on the position of the rotor nozzle in the space due to gravity.

In the embodiment shown, the separate insert piece 37 serves as a carrier for a preferably replaceable nozzle insert 49 by which a respectively desired jet shape, e.g. a spot jet or a flat jet can be set. The nozzle insert 49 can consist of another material than the insert piece 37, for example of metal or a ceramic material.

Figure 3:
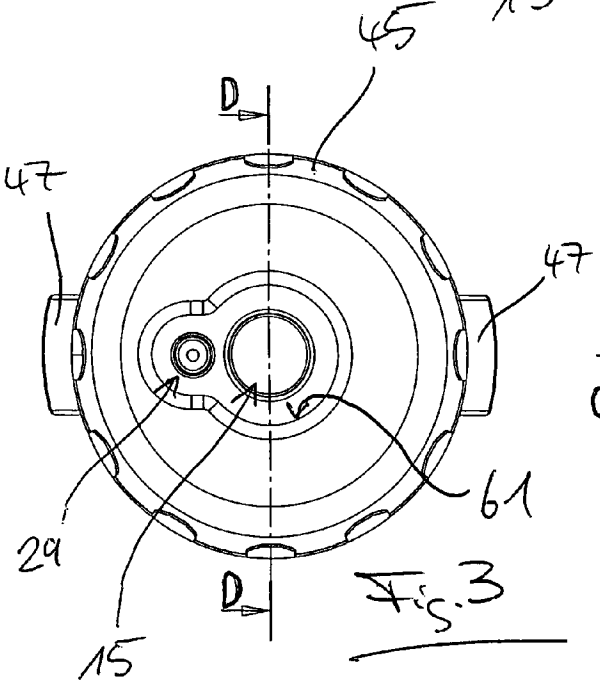

The central arrangement of the outlet opening 15 for the conical jet and the eccentric arrangement of the additional functional opening 29 can in particular be seen from FIG. 3. FIG. 3 additionally shows operating mode indicators 47 which are made in the form of radial projections at a cap 45 which is in particular manufactured from plastic and which is placed onto the nozzle housing 11 and is provided with a correspondingly shaped cut-out 61 in the region of the openings 15, 29.

Figure 4:
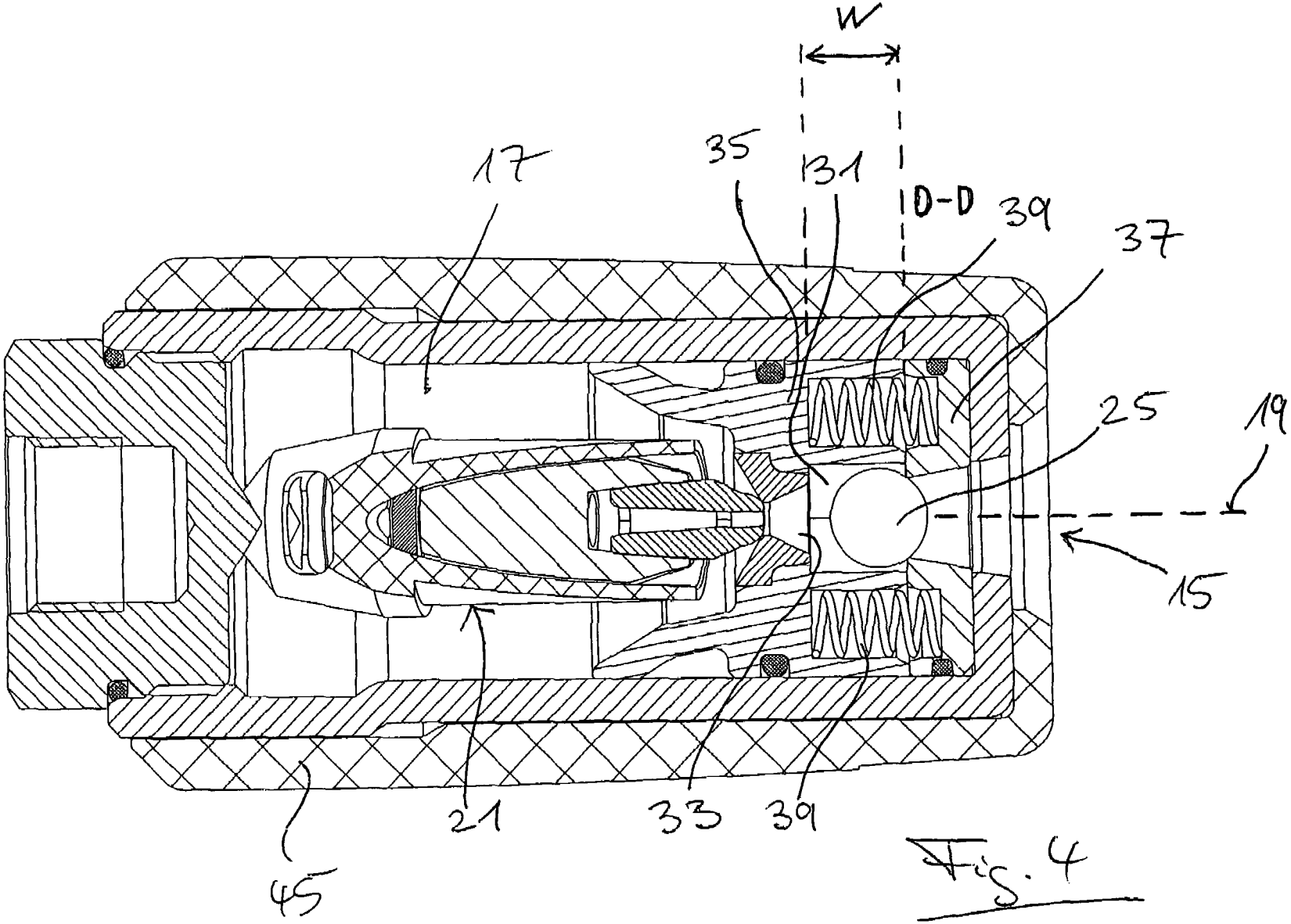
Figure 5:
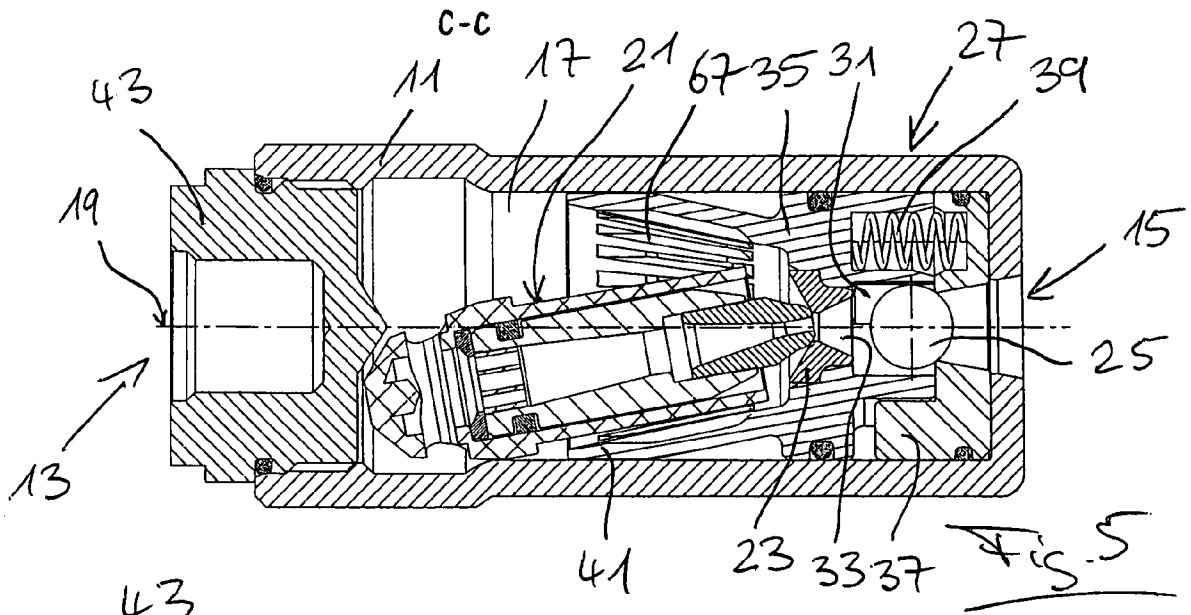
Figure 6:
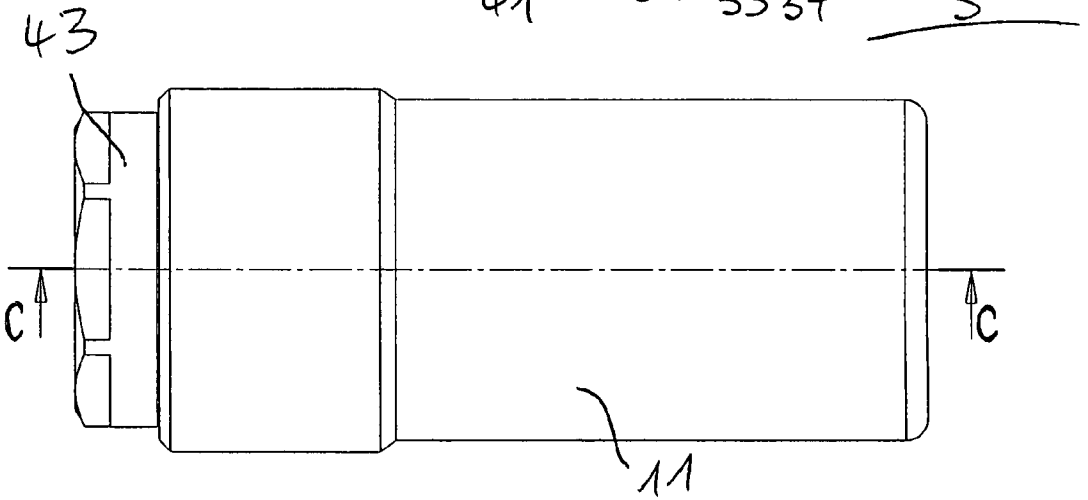
Figure 7:
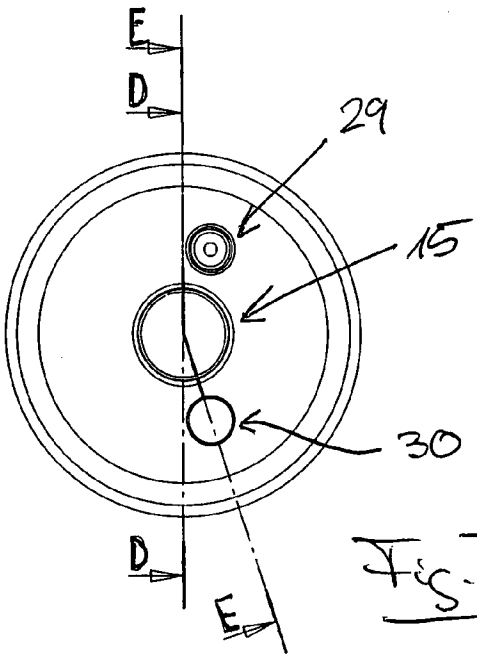

It can be seen from the sectional representation in FIG. 4 that two restoring elements, in each case in the form of a compression spring 39, are arranged at the same spacing from the longitudinal axis 19 between the front insert piece 37 and the piston member 35. In FIG. 4, the springs 39 are shown in the state pressed apart to the maximum in which the side of the piston member 35 at the front seen in the flow of direction comes into contact at the side of the separate insert piece 37 bounding the switching and pressure chamber 31. This position of the piston member 35 is only possible while overcoming the restoring force of the springs 39 if the swirl chamber 17 is under a fluid pressure during operation which drives the piston member 35 to the right in FIG. 4, i.e. in the direction of the outlet opening 15, toward the separate insert piece 37.

The size of the switching and pressure chamber 31 in the axial direction is dependent on the fluid pressure prevailing in the swirl chamber 17 in this respect.

The relationships are selected in this connection such that a passage width W of a switching track provided for the switching ball 25 inside the switching and pressure chamber 31, said passage shaft being available for the switching ball 25, is smaller during operation, that is with a switching and pressure chamber 31 reduced in size due to the fluid pressure, than the diameter of the switching ball 25 itself. A slight underdimensioning is completely sufficient in this connection. With a ball diameter of, for example, 8 mm, it is sufficient to provide a passage width W during operation of approximately 7.8 mm to achieve the desired effect which consists of preventing an unwanted influencing of the switching ball 25 during operation by the fluid flowing into the switching and pressure chamber 31.

This securing of the switching ball 25 or of the respective functional position of the switching ball 25 is in particular relevant when the switching ball 25 is in the position indicated by dashed lines in FIG. 1 in which the switching ball 25 closes the additional functional opening 29. Without the reduction in size of the switching and pressure chamber 31 which is explained above and by which the switching ball 25 is so-to-say captured in its position, there would be the risk that the switching ball 25 leaves its position closing the additional functional opening 29 due to a "suction effect" of the conical jet passing through the chamber 31 and exiting from the outlet opening 15 against the effect of gravity and instead moving in front of the outlet opening 15 for the conical jet in an unwanted manner.

Passages 63, 65 in the insert piece 37 each form a seat for the switching ball 25 at the chamber side. The diameters of the ball seats are dimensioned in dependence on the diameter of the switching ball 25 and of the passage width W of the switching and pressure chamber 31 adopted during operation such that the switching ball 25 is in each case seated low enough to have a sufficient spacing from the piston member 35 on the reduction in size of the chamber 31 being adopted during operation.

A tilting of the piston member 35 with respect to the longitudinal axis 19 is already practically precluded by the symmetrical arrangement of the two restoring springs 39 provided here. In addition, the piston member 35 is provided with a support extension 41 which is directed upstream and with which a support at the inner wall of the nozzle housing 11 takes place.

The switching between the two operating modes—conical jet via the outlet opening 15, on the one hand, and functional jet, e.g. spot jet or flat jet, via the additional functional opening 29, on the other hand—takes place in operating breaks in which the swirl chamber 17 is pressureless or is under a reduced fluid pressure so that the restoring springs 39 can restore the piston member 35 to the left in FIG. 4 away from the separate insert piece 37. The passage width W of the switching and pressure chamber 31 hereby enlarges so that the switching track provided therein for the switching ball 25 is released and, with a corresponding position of the rotor nozzle in the space, which is made recognizable for the user by the operating mode indicator 47 of the cap 45, the switching ball 25 can move into the respective other functional position in which the switching ball 25 sealingly closes either the outlet opening 15 for the conical jet or the additional functional opening 29.

The second embodiment in accordance with FIGS. 5 to 10 differs inter alia from the first embodiment by the aspect of the gravity circuit 27, but is generally based on the same principle as the first embodiment. The rotor nozzle in accordance with the second embodiment is shown without a cap here. A cap in accordance with the cap 45 explained in connection with the first embodiment can, however, basically be provided.

The rotor nozzle in accordance with the second embodiment is provided, in addition to the central outlet opening 15 for the conical jet, with two functional openings 29, 30 (FIG. 7) which make it possible to select between three different operating modes. The realization of the additional functional openings 29, 30 can in turn take place by separate nozzle inserts in accordance with the first embodiment for which the separate insert piece 37 serves as a support.

To achieve precisely one operating mode being set in each case in dependence on the orientation of the rotor nozzle in the space, i.e. in each case only one of the three openings 15, 29, 30 is released and the respective other two openings are closed, two switching elements 27 are arranged in the switching and pressure chamber 31 of the gravity circuit 27 and are here in turn made as switching balls 25, 26.

Unlike the first embodiment, only one single restoring spring 39 is provided. A risk of tilting which may potentially hereby be present is compensated by a larger support extension 41 of the piston member 35 directed upstream. The conically widening support extension 41 is provided at its inner side with a rib structure 67 which disturbs the swirl flow present in the swirl chamber 17 during operation, whereby an integrated "brake" is realized which is operative as an automatic speed limiter for the rotor 21.

Figures 8, 9:
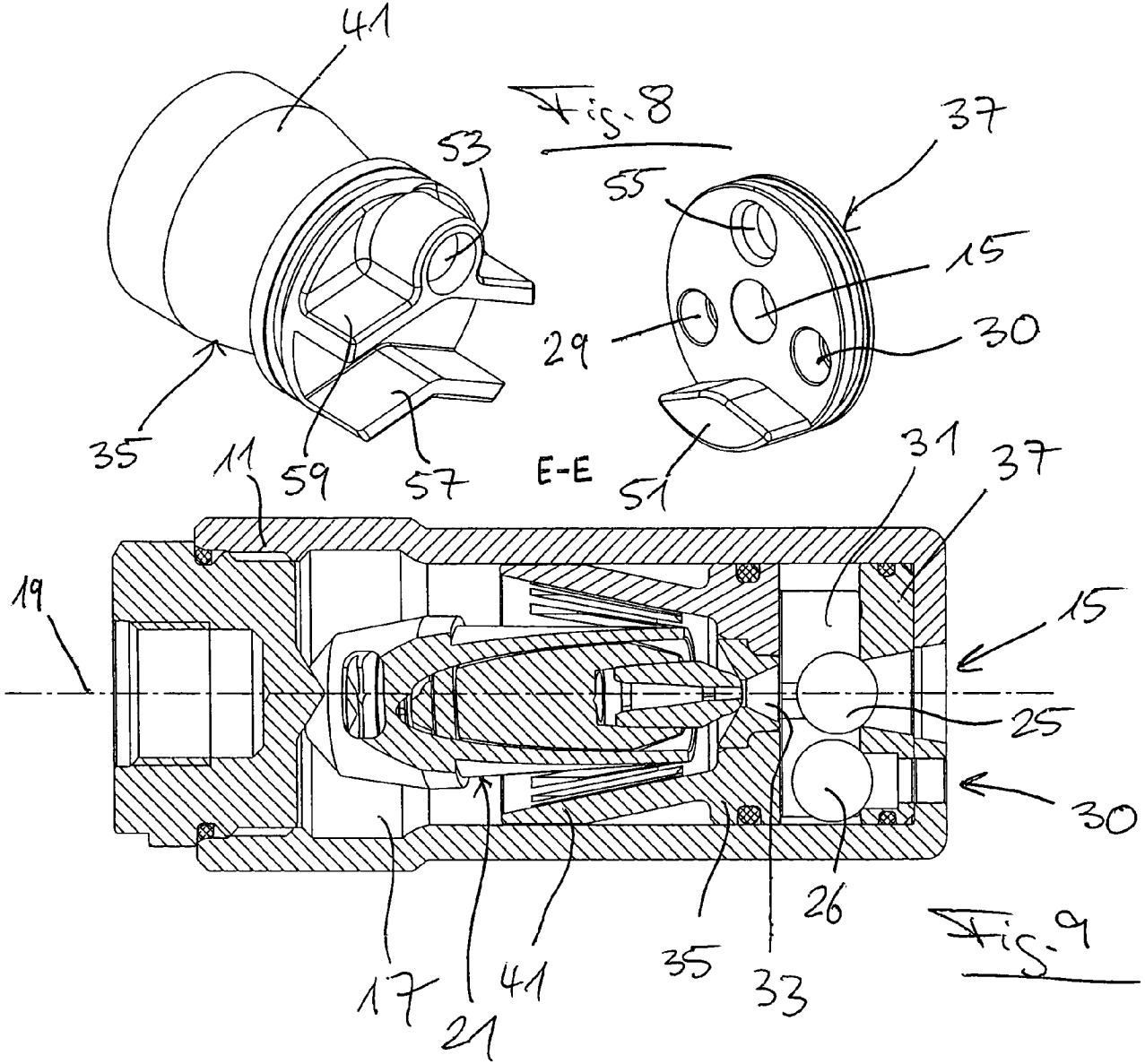
Figure 10:
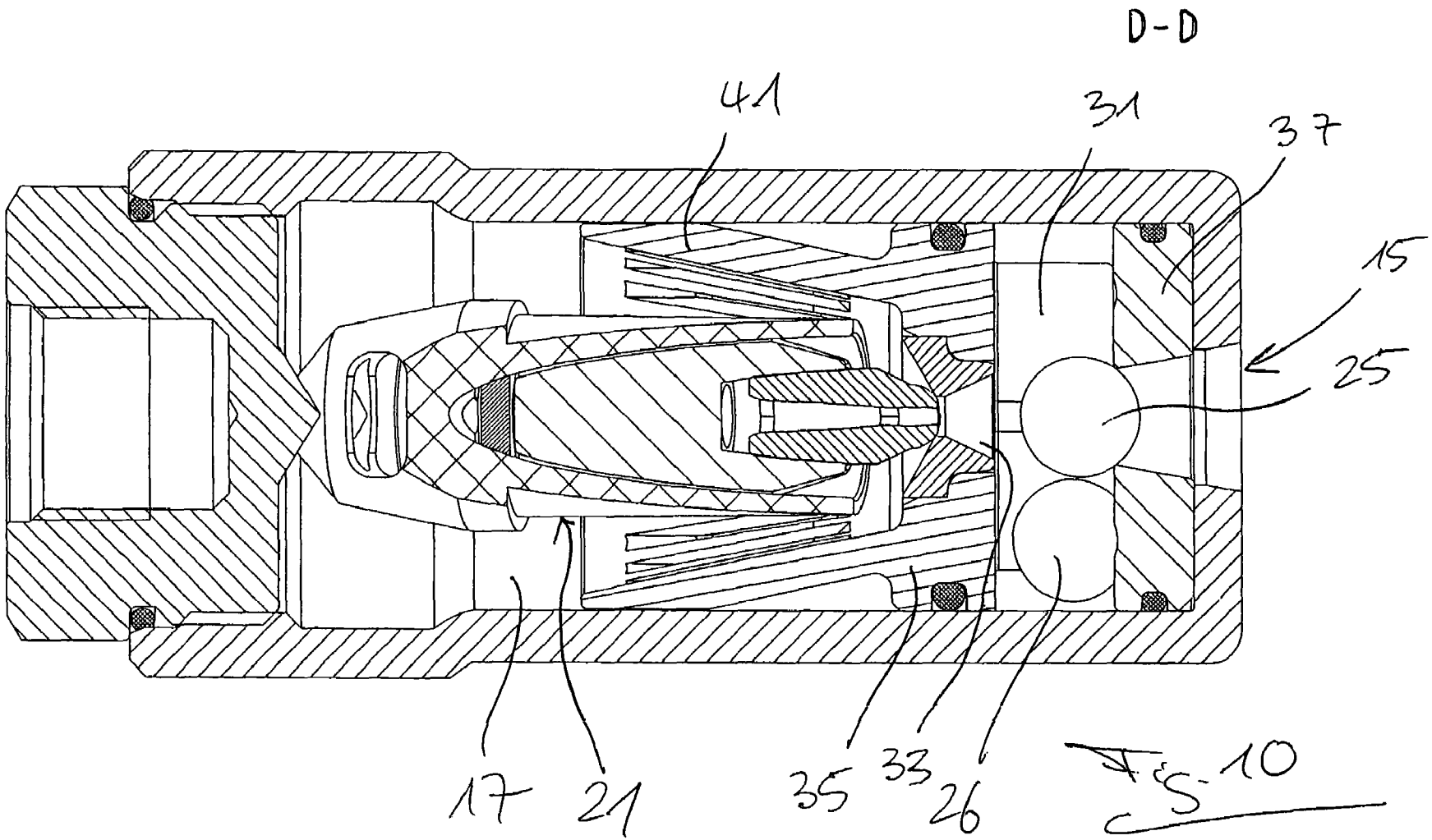

FIG. 8 shows in each case in a perspective view the sides of the piston member 35 which bound the switching and pressure chamber 31, on the one hand, and are the sides of the separate insert piece 37, on the other hand, and which each have integrated functional means. They include mounts 53, 55 for the restoring spring 39. Furthermore, the insert piece 37 is provided with a security against rotation 51 which is arranged diametrically opposite the spring mount 55 and which cooperates with one of two switching path boundaries 57, 59 of the piston member 35. The two switching track boundaries 57, 59 are each made in V shape, whereby, starting from a middle position, two ramp-like switching track sections result which are each provided for one of the two switching balls 25, 26.

In a "zero position" in accordance with FIG. 8, in which the centers of the two additional functional openings 29, 30 are disposed lower with respect to gravity than the center of the outlet opening 15 for the conical jet, the two switching balls 25, 26 close the two additional functional openings 29, 30 due to gravity. By rotating the rotary nozzle around its longitudinal axis 19 by 90° in the one or the other direction, the outlet opening 15 released in the mentioned neutral position is closed by the switching ball 25 or 26 which moves due to gravity, whereas the additional functional opening 30 or 29 disposed lower with respect to gravity continues to remain closed by the corresponding switching ball 26 or 25.

REFERENCE NUMERAL LIST

11 nozzle housing, pressure housing
13 inflow opening
15 outlet opening

17 swirl chamber
19 longitudinal axis
21 rotor
23 bearing
25 switching element, switching ball
26 switching element, switching ball
27 gravity circuit
29 functional opening
30 functional opening
31 switching and pressure chamber
33 exit opening
35 swirl chamber boundary, piston member
37 boundary, insert piece
39 restoring element, spring
41 support extension
43 connection piece, box
45 cap
47 operating mode indicator
49 nozzle insert
51 security against rotation
53 spring mount
55 spring mount
57 switching track boundary
59 switching track boundary
61 cut-out
63 passage
65 passage
67 rib structure
W passage width

The invention claimed is:

1. A rotary nozzle having a nozzle housing (11) which has a swirl chamber (17) between a rear inflow opening (13) for a fluid and a front outlet opening (15), with a front end of a rotor (21), which is inclined during operation toward a longitudinal axis (14), being supported at a bearing (23) in said swirl chamber and being able to be driven by fluid flowing into the swirl chamber (17) to make a rotary movement wound the longitudinal axis (19) such that the fluid exits the nozzle housing (11) via the outlet opening (15) in the form of a conical jet; and having a gravity circuit (27) which includes at least one movable switching element (25, 26) and which switches between at least two different operating modes by movement of the rotor nozzle in the space, characterized in that the gravity circuit (27) is arranged in the front region of the rotor nozzle downstream of the swirl chamber (17), with the switching element (25, 26) releasing the outlet opening (15) and closing a functional opening (29, 30) of the nozzle housing (11) provided in addition to the outlet opening (15), in one operating mode, and with the additional functional opening (29, 30) being released in at least one further operating mode in which the outlet opening (15) is sealingly closed by the switching element (25).

2. A rotor nozzle in accordance with claim 1, characterized in that the fluid can only be supplied to the additional functional opening (29, 30) via the rotor (21).

3. A rotary nozzle in accordance with claim 1, characterized in that the switching element (25, 26) is arranged in a size-variable space (31) which can adopt an operating configuration and a switchover configuration which differ from one another by the effective size of the space (31), with the switching element (25, 26) being held or captured by boundaries determining the size of the space (31) in accordance with the respectively set operating mode in the operating configuration and thus being prevented from a gravity-induced switchover, and with the boundaries of the space (31) allowing a free switchover movement to the switching element (25, 26) in the switchover configuration.

4. A rotor nozzle in accordance with claim 1, characterized in that the gravity circuit (27) includes a switching and pressure chamber (31) containing the switching element (25, 26) and into which an exit opening (33) of the swirl chamber (17) opens upstream and the outlet opening (15) as well as the additional functional opening (29, 30) of the nozzle housing (11) open downstream.

5. A rotor nozzle in accordance with claim 4, characterized in that the switching and pressure chamber (31) is bounded upstream by a piston member (35) which is axially movable in the nozzle housing (11) and which is acted on in the downstream direction with a pressurized swirl chamber (17).

6. A rotor nozzle in accordance with claim 5, characterized in that at least one restoring element (39) is arranged between the piston member (35) and a boundary (37) of the switching and pressure chamber (31) disposed downstream and its restoring force counters a reduction in size of the switching and pressure chamber (31) which is caused by the action of the piston member (35) with a pressurized swirl chamber (17).

7. A rotary nozzle in accordance with claim 5, characterized in that a switching track is provided for the switching element (25, 26) between the piston member (35) and the boundary (37) disposed downstream and its passage width (W) is dependent on the position of the piston member (35) in the nozzle housing (11), with the passage width (W) being smaller with a pressurized swirl chamber (17) and a switching and pressure chamber correspondingly reduced in size by the action of the piston member (35) than the operative dimension of the switching element (25, 26) with respect to the passage width (W) on the switchover.

8. A rotor nozzle in accordance with claim 1, characterized in that the switching element (25, 26) is provided in the form of a ball.

9. A rotor nozzle in accordance with claim 5, characterized in that the piston member (35) is provided wit, a security against tilting in the form of a support extension (41) extending upstream and cooperating with the inner wall of the nozzle housing (11).

10. A rotor nozzle in accordance with claim 1, characterized in that two switching elements (25, 26) and two additional, functional openings (29, 30) are provided.

11. A rotor nozzle in accordance with claim 1, characterized in that the swirl chamber (17) and the gravity circuit (27) are arranged sequentially seen in the direction of the longitudinal axis (19) and inside a common pressure housing (11) forming the nozzle housing.

12. A rotor nozzle in accordance with claim 1, characterized in that a boundary of the switching and pressure chamber (31) disposed downstream can be made at a separate end piece (37).

13. A rotor nozzle in accordance with claim 12, characterized in that the separate insert piece (37) and a swirl chamber boundary (35), can be sequentially plugged into the nozzle housing (11) and removed from the nozzle housing (11).

14. A rotor nozzle in accordance with claim 12, characterized in that the insert piece (37) and/or the swirl chamber boundary (35) is/are provided with means (57, 59; 53, 55; 51) for the fixing of a switching track for the switching element (25, 26), for the mounting of a restoring element (39) and/or for the securing of a mutual relative rotary position with respect to the longitudinal axis (19).

* * * * *